US010946435B2

(12) United States Patent
Fukumoto

(10) Patent No.: US 10,946,435 B2
(45) **Date of Patent: *Mar. 16, 2021**

(54) GREEN SAND MOLD AND ITS PRODUCTION METHOD, AND PRODUCTION METHOD OF IRON-BASED CASTING

(71) Applicant: HITACHI METALS, LTD., Tokyo (JP)

(72) Inventor: Kentaro Fukumoto, Fukuoka (JP)

(73) Assignee: HITACHI METALS, LTD., Tokyo (JP)

( * ) Notice: Subject to any disclaimer, the term of this patent is extended or adjusted under 35 U.S.C. 154(b) by 670 days.

This patent is subject to a terminal disclaimer.

(21) Appl. No.: 15/023,845

(22) PCT Filed: Sep. 30, 2014

(86) PCT No.: PCT/JP2014/076041
§ 371 (c)(1),
(2) Date: Mar. 22, 2016

(87) PCT Pub. No.: WO2015/046562
PCT Pub. Date: Apr. 2, 2015

(65) Prior Publication Data

US 2016/0236268 A1 Aug. 18, 2016

(30) Foreign Application Priority Data

Sep. 30, 2013 (JP) ..... JP2013-203816

(51) Int. Cl.
*B22C 1/22* (2006.01)
*B22C 3/00* (2006.01)
(Continued)

(52) U.S. Cl.
CPC ..... *B22C 9/02* (2013.01); *B22C 1/22* (2013.01); *B22C 3/00* (2013.01); *B22C 9/12* (2013.01); *B22D 15/00* (2013.01)

(58) Field of Classification Search
CPC ..... B22C 3/00
See application file for complete search history.

(56) References Cited

U.S. PATENT DOCUMENTS 2,273,326 A * 2/1942 McKee ..... B22C 3/00 106/237
2,313,674 A * 3/1943 Salzberg ..... B22C 1/2246 428/451
(Continued)

FOREIGN PATENT DOCUMENTS

GB 747579 A * 4/1956 ..... B22C 3/00
JP 47024852 B * 7/1972
(Continued)

OTHER PUBLICATIONS

Machine Translation of Uei (JP 59-10446 A, Jan. 19, 1984, cited in IDS) (Year: 1984).*
(Continued)

*Primary Examiner* — Kevin E Yoon
*Assistant Examiner* — Jacky Yuen
(74) *Attorney, Agent, or Firm* — Sughrue Mion, PLLC

(57) ABSTRACT

A green sand mold comprising at least one pair of green sand mold parts each comprising a recess and a mating surface, wherein a cured layer comprising a thermosetting resin as a main component is formed on the recess and mating surface of each green sand mold part, and wherein the cured layer has hardness of 40-98, a thickness of 0.5-6 mm, and gas permeability of 70-150, is produced by applying a curing material comprising the thermosetting resin as a main component and having viscosity of 1-100 mPa·S to the recess and mating surface of each green sand mold part, combining
(Continued)

the green sand mold parts, and then heat-hardening the curing material.

10 Claims, 4 Drawing Sheets

(51) Int. Cl.

| | |
|---|---|
| ***B22C 9/02*** | (2006.01) |
| ***B22C 9/12*** | (2006.01) |
| ***B22D 15/00*** | (2006.01) |

(56) References Cited

U.S. PATENT DOCUMENTS 2,425,978 A * 8/1947 Anderson, Jr. ..... B22C 3/00 164/369
3,519,457 A * 7/1970 Hammerton ..... B22C 23/02 427/133
3,654,261 A * 4/1972 Johnson ..... C08L 63/00 536/17.9
4,298,051 A * 11/1981 Page ..... B22C 1/185 106/38.27
4,636,262 A * 1/1987 Reed ..... B22C 1/02 106/38.3

FOREIGN PATENT DOCUMENTS

| | | | | |
|---|---|---|---|---|
| JP | 59-10446 | A | | 1/1984 |
| JP | 61056752 | A | * | 3/1986 |
| JP | 61-71153 | A | | 4/1986 |
| JP | 62248535 | A | * | 10/1987 |
| JP | 63-295040 | A | | 12/1988 |
| JP | 2004-195519 | A | | 7/2004 |
| JP | 2013-140102 | A | | 7/2013 |

OTHER PUBLICATIONS

International Search Report for PCT/JP2014/076041 dated Jan. 13, 2015 [PCT/ISA/210].
Communication dated Mar. 27, 2017 issued by the European Patent Office in the counterpart European application No. 14849585.6.
Anonymous: "Phenolic Novolac and Resol Resins—Phenolic thermosetting resin", Jan. 1, 2000, XP055356054, URL: https://www.plenco.com/phenolic-novolac-resol-resins.htm, 7 pages.

* cited by examiner

GREEN SAND MOLD AND ITS PRODUCTION METHOD, AND PRODUCTION METHOD OF IRON-BASED CASTING

CROSS REFERENCE TO RELATED APPLICATIONS

This application is a National Stage of International Application No. PCT/JP2014/076041, filed on Sep. 30, 2014 (which claims priority from Japanese Patent Application No. 2013-203816, filed on Sep. 30, 2013), the contents of which are incorporated herein by reference in their entirety.

FIELD OF THE INVENTION

The present invention relates to a green sand mold suitable for producing an iron-based casting, a method for efficiently producing such a green sand mold, and a method for producing an iron-based casting using such a green sand mold.

BACKGROUND OF THE INVENTION

A green sand mold composed of compressed green sand has been widely used for many years, because its molding cost is lower than those of a shell mold and a cold-box mold. As shown in FIG. 4, a conventional method for producing a green sand mold comprises the steps of (1) forming green sand mold parts 1*a*, 1*b* having desired recesses 3*a*, 3*b* by setting a pattern member 12*a*, 12*b* inside each flask 11 on each bottom board 13, charging green sand containing about several percentages of water, a clay, etc. into each flask 11, and then compressing it; (2) removing the bottom board and the pattern member from each flask, and (3) and (4) combining both mold parts 1*a*, 1*b*, such that their recesses 3*a*, 3*b* are matched with each other to form a cavity 6. Because the surfaces 4*a*, 4*b* of the compression-molded green sand molds 1*a*, 1*b* are convexly deformed due to the spring back of green sand after removing the bottom board and the pattern member, they should be deformable by compression when combining both mold parts. With such deformability (conformability), the surfaces 4*a*, 4*b* are brought into close contact as shown in the step (4).

However, the green sand mold is poorer than the shell mold and the cold-box mold in detachment of sand when the mold is shaken out. To suppress the detachment of sand, JP 59-10446 A discloses a method of spray-coating the mating surfaces and cavity surfaces of green sand mold parts with water glass as a curing material, and causing a $CO_2$ gas to pass through the combined green sand mold parts to cure the water glass. However, it has been found that when the water-glass-coated green sand mold parts are combined, the cavity of the green sand mold may be deformed because of the weight of the green sand mold and the flask applied to the mating surfaces.

JP 61-71153 A discloses a green sand mold provided with nearly the low hardness as that of a self-hardening casting mold by impregnating the green sand mold with a solidifying liquid composed of a furan resin binder and an organic sulfonic acid curing material by suction, and then leaving it to stand to cure the solidifying liquid. However, when the coated solidifying liquid is sucked, it excessively penetrates into the green sand mold, providing insufficient hardness to the mating surfaces. If a large amount of the solidifying liquid were coated to obtain sufficient hardness, the casting mold would have extremely low gas permeability, thereby likely generating gas defects such as pinholes in the resultant iron-based casting. Also, if the mold parts were combined after the furan resin binder is completely cured, a pair of the green sand mold parts would not come into close contact with each other, because the mating surfaces do not have deformability (conformability), resulting in gaps between the mating surfaces.

OBJECT OF THE INVENTION

Accordingly, a first object of the present invention is to provide a curing-material-coated green sand mold having enough hardness and permeability, suitable for producing an iron-based casting having excellent dimensional accuracy and appearance.

A second object of the present invention is to provide a method for efficiently producing such a green sand mold.

A third object of the present invention is to provide a method for producing an iron-based casting having excellent dimensional accuracy and appearance, using such a green sand mold.

DISCLOSURE OF THE INVENTION

As a result of intensive research in view of the above objects, the inventor has found that a green sand mold capable of casting an iron-based casting having excellent dimensional accuracy and appearance can be obtained by coating each green sand mold part with a curing material, combining the green sand mold parts with their mating surfaces kept sufficiently deformable, and then hardening the curing material. The present invention has been completed on the basis of such finding.

Thus, the green sand mold of the present invention comprises at least one pair of green sand mold parts each comprising a recess and a mating surface; a cured layer comprising a thermosetting resin as a main component being formed on the recess and mating surface of each green sand mold part; and the cured layer having hardness of 40-98, a thickness of 0.5-6 mm, and gas permeability of 70-150.

The thermosetting resin is preferably at least one of a phenol resin, an epoxy resin and a furan resin.

The method of the present invention for producing the above green sand mold comprises the steps of applying a curing material comprising a thermosetting resin as a main component and having viscosity of 1-100 mPa·S to the recess and mating surface of each green sand mold part, combining the green sand mold parts, and then heat-hardening the curing material.

The curing material is preferably a solution of the thermosetting resin in alcohol.

The amount of the curing material applied is preferably 100-550 g/m$^2$.

A first method for producing the above green sand mold comprises the steps of applying a curing material having viscosity of 1-15 mPa·S to the recess and mating surface of each green sand mold part, semi-hardening the curing material to form a semi-cured layer, combining the green sand mold parts, and then heating the semi-cured layer to form a substantially completely cured layer.

In the first production method of the green sand mold, the hardness of the semi-cured layer is preferably 30-45, and the thickness of the cured layer is preferably 2.2-6 mm.

A second method for producing the above green sand mold comprises the steps of applying a curing material having viscosity of 15-100 mPa·S to the recess and mating surface of each green sand mold part, combining the green sand mold parts, and then heat-hardening the curing material to form a substantially completely cured layer.

In the second production method of the green sand mold, the hardness of a curing material layer before combining the green sand mold parts is preferably 5-30, and the thickness of the cured layer is preferably 0.5-2.2 mm.

The method of the present invention for producing an iron-based casting using the above green sand mold comprises the steps of combining the green sand mold parts, forming the cured layer by heating, and then filling a cavity defined by the recesses of the combined green sand mold parts with an iron-based melt.

BRIEF DESCRIPTION OF THE DRAWINGS

FIG. 1(*b*) is an exploded cross-sectional view showing the green sand mold of the present invention.

DESCRIPTION OF THE PREFERRED EMBODIMENTS

The embodiments of the present invention will be explained in detail below without intention of restricting the present invention thereto, and various modifications may be made within a scope of the present invention.

The "viscosity" of the curing material is a value measured by a Brookfield viscometer according to JIS K6910 here. Regarding the cured layer, the "hardness" is a value measured using a self-hardening hardness meter (NK-009) available from Nakayama Co., Ltd., the "thickness" is a value determined from a SEM photograph, and the "gas permeability" is a value measured by a rapid method described in Annex 3 of JIS Z 2601.

[1] Green Sand Mold

Figure 1A:
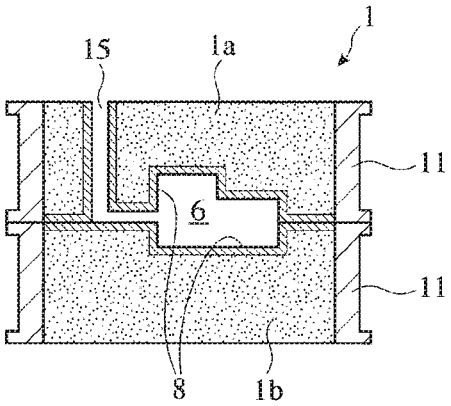
FIG. 1(*a*) is a cross-sectional view showing the green sand mold of the present invention.
Figure 1B:
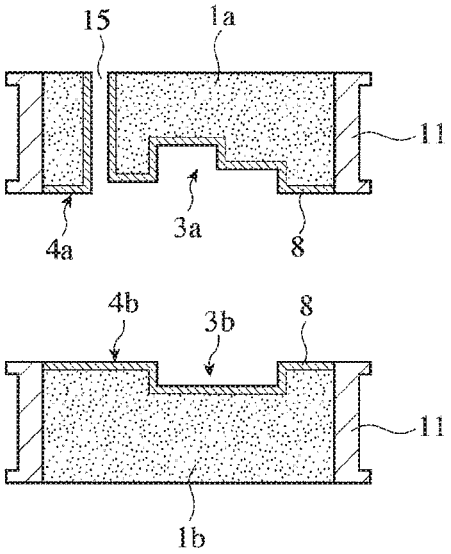

As shown in FIGS. 1(*a*) and 1(*b*), the green sand mold 1 of the present invention comprises at least one pair of green sand mold parts 1*a*, 1*b* each comprising a recess 3*a*, 3*b* and a mating surface 4*a*, 4*b*; (a) a cured layer 8 comprising a thermosetting resin as a main component being formed on the recess 3*a*, 3*b* and mating surface 4*a*, 4*b* of each green sand mold part 1*a*, 1*b;* and (b) the cured layer 8 having hardness of 40-98, a thickness of 0.5-6 mm, and gas permeability of 70-150. The recess 3*a*, 3*b* includes a portion for forming a casting cavity 6 when the green sand mold parts 1*a*, 1*b* are combined, and hollow portions such as a runner 15 communicating with the cavity 6 in the green sand mold.

The cured layer 8 comprises a thermosetting resin as a main component to secure sufficient hardness and gas permeability as well as to suppress sand detachment by mold shakeout, even when the cured layer 8 is thin. The thermosetting resins having higher high-temperature strength than thermoplastic resins are resistant to melt pressure in the cavity, thereby reducing penetration of the melt into the green sand mold. In addition, thermosetting resins are advantageous in retaining larger gas permeability than water glass. The thermosetting resin is preferably at least one of a phenol resin, an epoxy resin and a furan resin. Among them, a phenol resin is preferable.

The cured layer 8 should have hardness of 40-98. The hardness of 40 or more sufficiently suppresses sand detachment, thereby providing an iron-based casting with good appearance. The hardness of 98 or less secures desired gas permeability, likely generating little gas defects such as pinholes without wasting the thermosetting resin. The hardness of the cured layer 8 is preferably has 45-95.

The hardness measured by a self-hardening hardness meter may be extremely low in some portions of the green sand mold parts 1*a*, 1*b* having complicated recesses. To avoid measurement errors, therefore, the hardness is measured at 5 sites of the cured layer 8 excluding its portions having extremely low measured value of hardness (portions within 50 mm from a flask, and a deep cavity), and then averaged. This method is also used to measure the hardness of the semi-cured layer 7 described below.

The cured layer 8 should have a thickness of 0.5-6 mm. When the thickness of the cured layer 8 is 0.5 mm or more, a sufficient effect of suppressing sand detachment can be obtained. When the thickness of the cured layer 8 is 6 mm or less, the permeation of a gas is not suppressed while an iron-based melt is charged into the green sand mold, thereby reducing pinholes in the casting. The thickness of the cured layer 8 is preferably 1-5 mm.

The cured layer 8 should have gas permeability of 70-150. The gas permeability of less than 70 may generate defects such as pinholes. When the gas permeability is more than 150, the amount of the curing material applied is inevitably small, resulting in insufficient hardness of the cured layer 8, and thus deteriorating the degree of sand detachment by mold shakeout. The gas permeability of the cured layer 8 is preferably 100-150.

The green sand mold of the present invention comprises as thin a cured layer 8 as 0.5-6 mm formed on the recesses 3*a*, 3*b* and the mating surfaces 4*a*, 4*b*, having as relatively high hardness as 40-98 and as sufficient gas permeability as 70-150. Such features can be obtained by forming the cured layer 8 on the mating surfaces. Because the cured layer 8 is formed only on the recesses 3*a*, 3*b* and the mating surfaces 4*a*, 4*b*, the amount of the thermosetting resin applied can be reduced.

[2] Production Method of Green Sand Mold

The method of the present invention for producing the green sand mold comprising the steps of (1) applying a curing material 2 comprising a thermosetting resin as a main component and having viscosity of 1-100 mPa·S to the recess 3*a*, 3*b* and mating surface 4*a*, 4*b* of each green sand mold part 1*a*, 1*b,* and (2) heat-hardening the curing material 2 after the green sand mold parts 1*a,* 1*b* are combined.

The curing material is preferably a solution of the thermosetting resin in alcohol so as to dry immediately after applying. Though the alcohol is not restrictive as long as having a low molecular weight, it is preferably ethanol, isopropyl alcohol, etc. from the aspect of working environment.

The viscosity of the curing material can be controlled by adjusting a concentration of the thermosetting resin in the curing material. To obtain the cured layer 8 meeting the above requirements (hardness of 40-98, a thickness of 0.5-6 mm, and gas permeability of 70-150), the viscosity of the curing material should be 1-100 mPa·S. When the viscosity of the curing material is less than 1 mPa·S, the curing material penetrates too deeply from the surfaces of the green sand mold parts 1*a*, 1*b*, thereby hardly remaining near the surfaces, failing to provide the cured layer 8 having sufficient hardness. If such a curing material were applied in a large amount to form the cured layer 8 having sufficient hardness, it would be economically disadvantageous and suffer the generation of a large amount of a gas when a melt is poured, likely providing a cast product with pinholes. When the viscosity exceeds 100 mPa·S, the curing material hardly penetrates into the green sand mold parts 1*a*, 1*b*, and shrunk by curing, so that the cured layer easily peels off from the surface of each green sand mold part 1*a*, 1*b*. Of course, portions of the green sand mold where the cured layer peels off are infiltrated with a melt, likely deteriorating the degree of sand detachment and causing seizure.

To obtain the cured layer 8 meeting the above requirements, the amount of the curing material applied is preferably 100-550 g/$m^2$. When the amount of the curing material applied is too small, the detachment of sand cannot be sufficiently suppressed. When the curing material is excessively applied, the green sand mold has small gas permeability, generating gas defects. The amount of the curing material applied is expressed here by an amount (g) of the curing material applied per a projected area of the green sand mold 1 [an area ($m^2$) of the green sand mold 1 in plan view]. When the flask is used, the projected area is the longitudinal length×the lateral length ($m^2$) of an inner surface of the flask.

When the mold parts are combined before the curing material is substantially completely hardened to form the hard cured layer 8, the cured layer 8 can be prevented from being damaged. After the mold parts are combined, the curing material can be substantially completely cured by heating to about 80-180° C. Though the heating-temperature-holding time is variable depending on the size of the green sand mold, it may be generally about 1-3 minutes.

The method of the present invention for producing the green sand mold includes (a) a first method comprising the steps of coating the green sand mold parts 1*a*, 1*b* with the curing material 2, hardening them insufficiently by heating to some extent, combining them, and then curing it substantially completely by heating again to form the cured layer 8; and (b) a second method comprising the steps of combining the green sand mold parts 1*a*, 1*b* coated with the curing material 2, and then curing it substantially completely by heating to form the cured layer 8. Each method will be explained in detail below.

(A) First Method

The first method of the present invention for producing the green sand mold comprises first and second steps of hardening the curing material. As specifically shown in FIG. 1, the first method comprises the steps of (1) applying the curing material 2 having viscosity of 1-15 mPa·S to the recess 3*a*, 3*b* and mating surface 4*a*, 4*b* of each green sand mold part 1*a*, 1*b*, (2) semi-hardening the curing material 2 to form a semi-cured layer, (3) combining the green sand mold parts 1*a*, 1*b*, and then heating the semi-cured layer 7 to form a substantially completely cured layer 8.

Figure 2:
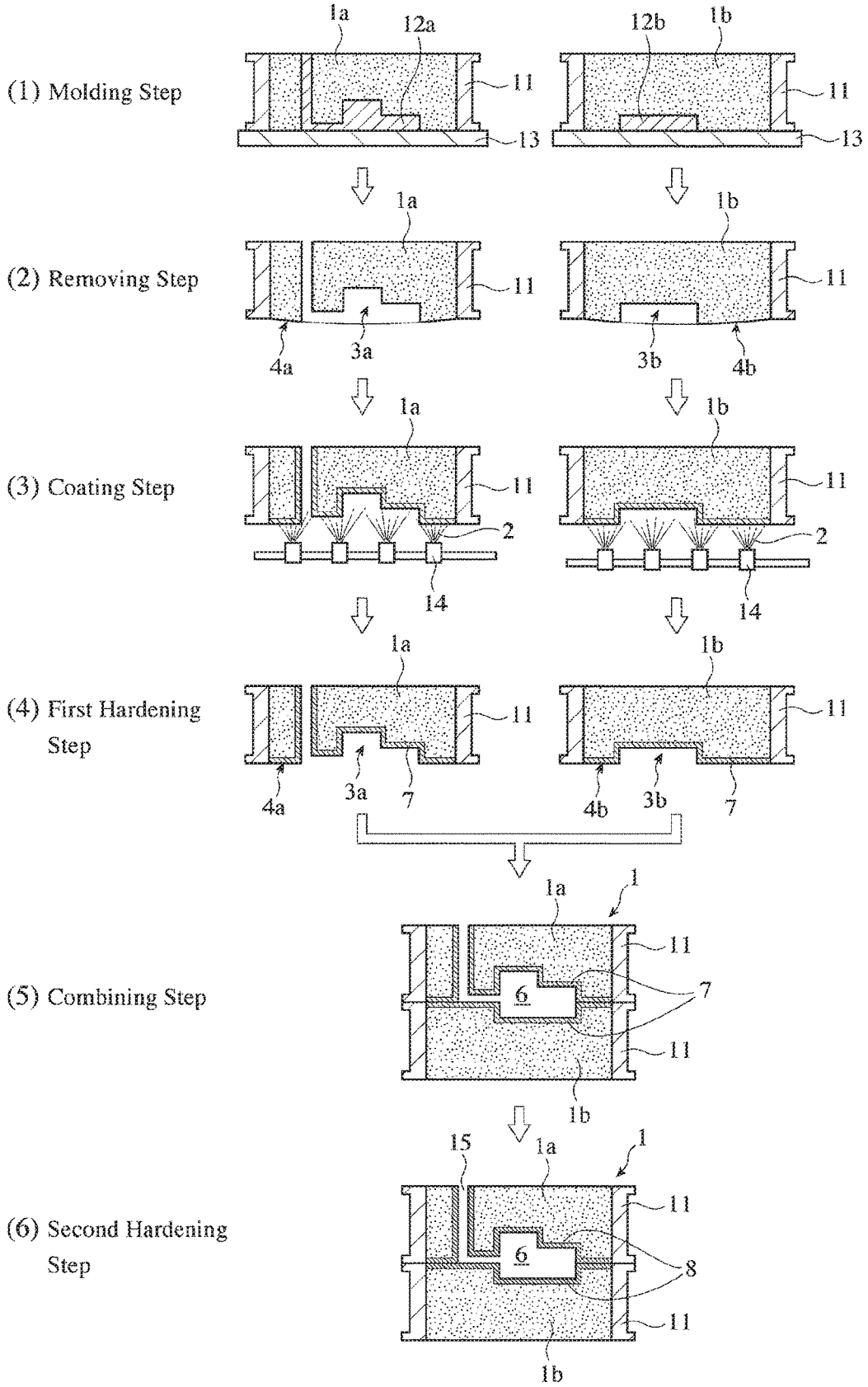
FIG. 2 is a schematic view showing steps of the first method of the present invention for producing a green sand mold.

When the viscosity of the curing material 2 is as small as 1-15 mPa·S, the curing material 2 largely penetrates each green sand mold part 1*a*, 1*b*, resulting in a low-hardness curing material layer (curing-material-impregnated green sand layer). As shown in FIG. 2, therefore, conducted are a first hardening step of semi-hardening the curing material 2 applied to the recess 3*a*, 3*b* and mating surface 4*a*, 4*b* of each green sand mold part 1*a*, 1*b*; and a second hardening step of substantially completely hardening the semi-cured layer 7 after combining the green sand mold parts 1*a*, 1*b* via the semi-cured layer 7. The curing material 2 preferably has viscosity of 2 mPa·S or more, more preferably 3 mPa·S or more. The viscosity of the curing material 2 can be controlled by adjusting a concentration of the thermosetting resin.

In the first hardening step, each green sand mold part 1*a*, 1*b* is preferably heated at 80-180° C. for 1-3 minutes. The more preferred heating temperature is 100-130° C., and the more preferred heating time is 1-2 minutes.

The semi-cured layer 7 preferably has hardness of 30-45. As described above, the hardness is measured at 5 sites of the semi-cured layer 7 excluding its portions having extremely low hardness (portions within 50 mm from a flask, and a deep cavity), and then averaged. Because the semi-cured layer 7 having hardness of 30 or more is not crushed when the mold parts are combined, the resultant iron-based casting has little defects in its dimension and appearance. When the hardness is 45 or less, the semi-cured layer 7 is sufficiently deformable to prevent the mold parts from being broken when combined.

In the second hardening step, the green sand mold parts 1*a*, 1*b* combined are preferably heated at 80-180° C. for 1-3 minutes. The more preferred heating temperature is 100-130° C., and the more preferred heating time is 1-2 minutes.

Because the low-viscosity curing material 2 sufficiently penetratable into the green sand mold parts 1*a*, 1*b* is used in the first method, the semi-cured layer 7 and cured layer 8 are relatively thick. The cured layer 8 (semi-cured layer 7) preferably has a thickness of 2.2-6 mm. Of course, the cured layer 8 formed by the first method has hardness of 40-98 and gas permeability of 70-150.

As described above, because the semi-cured layer 7 formed in first hardening step has sufficient hardness to withstand forces and sufficient deformability to absorb shocks when the mold parts are combined, the mold parts can be well combined. After the mold parts are combined, the semi-cured layer 7 is substantially completely hardened to form the cured layer 8 having sufficient hardness in the second hardening step, thereby suppressing sand detachment by mold shakeout, providing a casting with good appearance.

(B) Second method

The second method of the present invention for producing the green sand mold comprises the steps of (1) applying the curing material 2' having viscosity of 15-100 mPa·S to the recess 3*a*, 3*b* and mating surface 4*a*, 4*b* of each green sand mold part 1*a*, 1*b*, and (2) heat-hardening the curing material 2' in the combined green sand mold parts 1*a*, 1*b* to form a substantially completely cured layer 8.

In the second method, because the curing material 2' is cured by one step, the curing material 2' has as relatively large viscosity as 15-100 mPa·S. When the viscosity is 15 mPa·S or more, the curing material 2' hardly penetrates into each green sand mold part 1*a*, 1*b*, whereby a thin curing material layer 7' formed is little crushed when the mold parts are combined. The curing material layer 7' preferably has a thickness of 0.5-2.2 mm.

The curing material layer 7' preferably has hardness of 5-30 before the mold parts are combined. When the hardness is 5 or more, the curing material layer 7' is not crushed when the mold parts are combined. The curing material layer 7' having hardness of 30 or less is sufficiently deformable to prevent the mold parts from being broken when combined, and the cured layer 8 obtained by the curing material layer 7' has sufficient gas permeability, likely generating little gas defects such as pinholes in the resultant iron-based casting.

To harden the curing material layer 7' substantially completely by one step, the combined green sand mold parts 1*a*, 1*b* are preferably heated at 80-180° C. for 1-3 minutes. The more preferred heating temperature is 100-130° C., and the more preferred heating time is 1-2 minutes.

The cured layer 8 obtained by hardening the curing material layer 7' preferably has a thickness of 0.5-2.2 mm. When the cured layer 8 has a thickness of 0.5 or more, sand detachment can be sufficiently suppressed. The cured layer 8 having a thickness of 2.2 mm or less does not deteriorate gas permeability while a melt is charged into a mold, likely generating little pinholes in the casting. Of course, the cured layer 8 formed by the second method also has hardness of 40-98 and gas permeability of 70-150.

The present invention will be explained in further detail by Examples below without intention of restricting the present invention thereto.

EXAMPLE 1

Casting with Green Sand Mold Obtained by First Method (1) Molding Step

Green sand was prepared by kneading silica sand, water and a clay at a mass ratio of 100:3:1, and pattern members 12*a*, 12*b* were set in a flask 11 (inner size: 0.5 m×0.6 m) on a bottom board 13 as shown in FIG. 2. The green sand was charged into the flask 11, and compressed by a jolt-squeeze method to form a green sand mold part (upper mold) 1*a* and a green sand mold part (lower mold) 1*b*. The hardness of each of the upper and lower molds 1*a*, 1*b* was measured at 5 sites of each flat portion of their mating surfaces 4*a*, 4*b*, which were away from the flask 11 by 50 mm or more, by a hardness meter (NK-009) available from Nakayama Co., Ltd., and then averaged. It was thus found that each of the upper and lower molds 1*a*, 1*b* had hardness of 20.

(2) Coating Step

The recess 3*a*, 3*b* and mating surface 4*a*, 4*b* of each of the upper and lower molds 1*a*, 1*b* were sprayed with a solution of a phenol resin in ethanol (viscosity: 10 mPa·S) as a curing material 2 by a coating apparatus 14, and then dried. The amount of the curing material 2 applied to the mating surface 4*a*, 4*b* of each of the upper and lower molds 1*a*, 1*b* was 120 g corresponding to 400 g/m$^2$ per an area of the mating surface 4*a*, 4*b*. The mating surface coated with the curing material 2 had hardness of 8, which was measured in the same manner as above.

(3) First Hardening Step

The curing material layer formed on each mating surface 4*a*, 4*b* was semi-hardened by heating at 105° C. for 1 minute by an incandescent lamp. The hardness of the semi-cured layer 7 can be controlled by adjusting the temperature and lighting time of the incandescent lamp. The semi-cured layer 7 had hardness of 43, which was measured in the same manner as above.

(4) Combining Step

The upper and lower molds 1*a*, 1*b* each having the semi-cured layer 7 on the mating surface 4*a*, 4*b* were combined.

(5) Second Hardening Step

The semi-cured layer 7 was hardened again to a cured layer 8 having a thickness of 3 mm by supplying hot air at 105° C. to a cavity 6 through a sprue 15. The cured layer 8 had hardness (measured in the same manner as above) of 76, and gas permeability of 110.

(6) Evaluation

After pouring a melt into the finished green sand mold 1, the degree of sand detachment by mold shakeout and the appearance of the resultant casting were observed. The results are shown in Table 1. The sand detachment degree is expressed by a relative value of the mass of green sand attached to the runner and product after mold shakeout, when the mass in Comparative Example 1 is regarded as 100%. As the sand detachment degree is smaller, the green sand attached to the resultant casting can be removed more easily.

COMPARATIVE EXAMPLE 1

Figure 4:
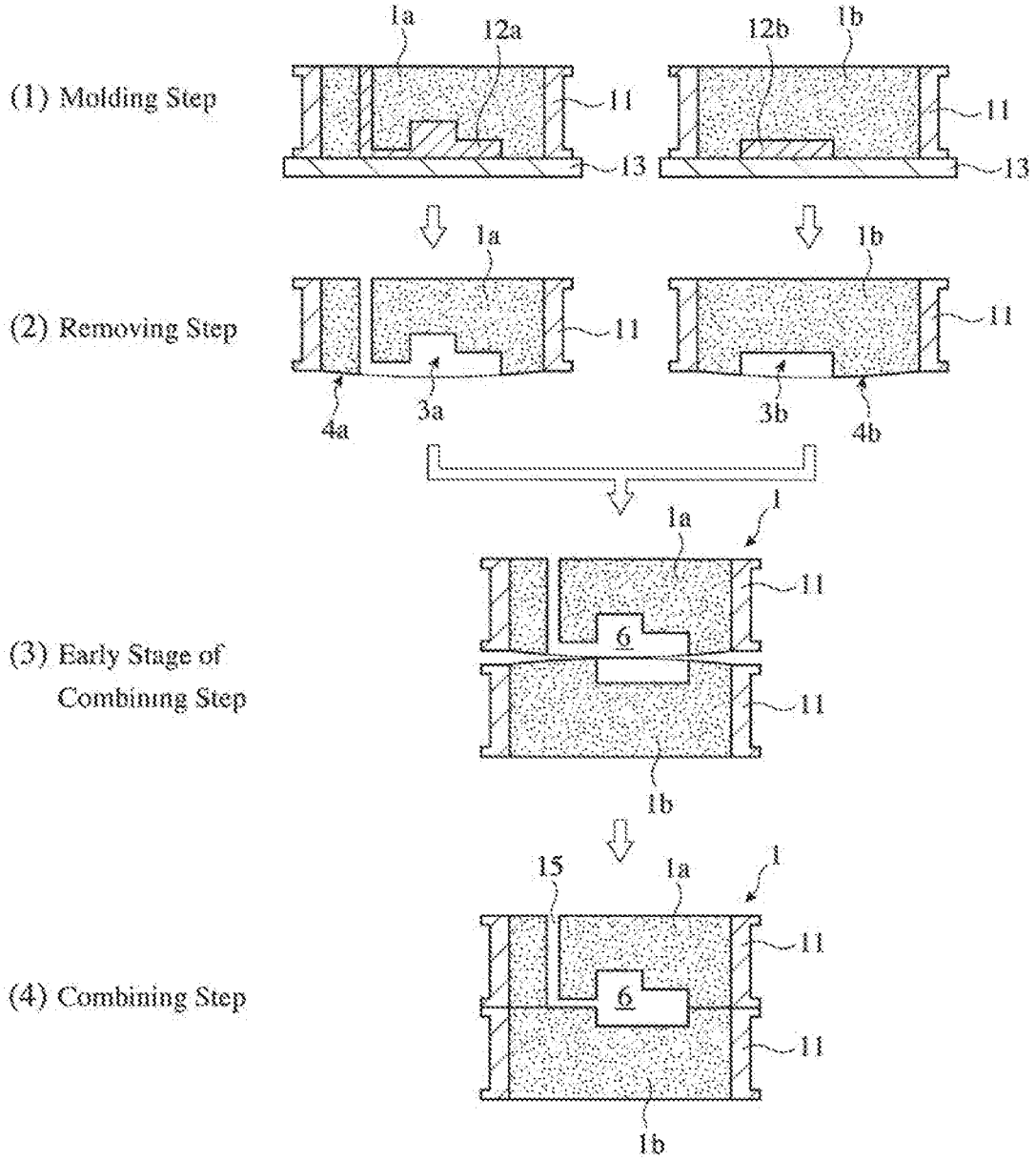
Fig. 4 Conventional Art
FIG. 4 is a schematic view showing steps of a conventional method for producing a green sand mold.

As shown in FIG. 4, the green sand mold 1 was produced in the same manner as in Example 1 except for applying no curing material. The degree of sand detachment by mold shakeout and the appearance of the casting were evaluated. The results are shown in Table 1. The curing-material-free recess of the green sand mold 1 had gas permeability of 160. With no curing material applied, mold shakeout caused more sand detachment.

COMPARATIVE EXAMPLE 2

The green sand mold 1 was produced in the same manner as in Example 1, except that the first curing material had viscosity of 0.5 mPa·S, that the amount of the curing material applied was 800 g/m$^2$, and that the cured layer had a thickness of 8 mm. The degree of sand detachment by mold shakeout and the appearance of the casting were evaluated. The results are shown in Table 1. The semi-cured layer 7 had hardness of 25. The cured layer 8 had hardness of 60 and gas permeability of 68.

EXAMPLES 2-5 AND COMPARATIVE EXAMPLE 3

The green sand molds 1 were produced in the same manner as in Example 1 except for changing the type, viscosity and amount of the curing material, and the first and second hardening steps as shown in Table 1. The degree of sand detachment by mold shakeout and the appearance of the casting were evaluated. The hardness was adjusted by the time of the first and second hardening steps. The results are shown in Table 1.

TABLE 1

| | No. | | | |
|---|---|---|---|---|
| | Example 1 | Com. Ex. 1 | Com. Ex. 2 | Example 2 |
| Hardness of Green Sand Mold | 20 | 20 | 20 | 25 |
| Curing Material | | | | |
| Type | Ph(1) | — | Ph(1) | Ph(1) |
| Viscosity (mPa · S)(5) | 10 | — | 0.5 | 1 |
| Amount (g/m$^2$) | 400 | — | 800 | 550 |
| Hardness after Coated | 8 | — | 8 | 6 |
| First Hardening Step | | | | |
| Hardness of Semi-Cured Layer | 43 | — | 25 | 30 |
| Cured Layer Obtained by Second Hardening Step | | | | |
| Hardness | 76 | — | 60 | 40 |
| Thickness (mm) | 3 | — | 8 | 5 |
| Gas Permeability(6) | 110 | 160 | 68 | 135 |
| Evaluation | | | | |
| Sand Detachment Degree (%) | 67 | 100 | 70 | 75 |
| Appearance of Casting | Very Good | Fair | Poor | Very Good |

TABLE 1-continued

| | No. | | | |
|---|---|---|---|---|
| | Example 3 | Example 4 | Example 5 | Com. Ex. 3 |
| Hardness of Green Sand Mold | 20 | 18 | 19 | 19 |
| Curing Material | | | | |
| Type | Ph(1) | Ep(2) | Fr(3) | Gl(4) |
| Viscosity (mPa · S)(5) | 15 | 10 | 5 | 2 |
| Amount (g/m$^2$) | 100 | 220 | 620 | 98 |
| Hardness after Coated | 8 | 7 | 6 | 13 |
| First Hardening Step | | | | |
| Hardness of Semi-Cured Layer | 45 | 26 | 55 | 35 |
| Cured Layer Obtained by Second Hardening Step | | | | |
| Cured Layer | | — | | |
| Hardness | 95 | 40 | 98 | 55 |
| Thickness (mm) | 2.2 | 2.2 | 6 | 4 |
| Gas permeability(6) | 120 | 150 | 70 | 62 |
| Evaluation | | | | |
| Sand Detachment Degree (%) | 72 | 78 | 73 | 88 |
| Appearance of Casting | Very Good | Good | Good | Poor |

Note:
(1)Phenol resin.
(2)Epoxy resin.
(3)Furan resin.
(4)Water glass.
(5)Viscosity measured by a Brookfield viscometer according to JIS K6910.
(6)Measured by a rapid method described in Annex 3 of JIS Z 2601.

As is clear from Table 1, both of the sand detachment degree by mold shakeout and the appearance of the casting were good in Examples 1-5 using the green sand mold formed by applying the curing material having viscosity of 1-15 mPa·S to the mating surface of each green sand mold part, forming the semi-cured layer in the first hardening step, combining the green sand mold parts, and then forming the cured layer in the second hardening step. Especially in Examples 1-3, the sand detachment degree and the appearance of the casting were very good, because a phenol resin was used as the thermosetting resin, the semi-cured layer had hardness of 30-45, and the cured layer had hardness of 40-98, a thickness of 2.2-6 mm, and gas permeability of 70-150. In Example 4, the resultant casting had good appearance as a whole, despite slight burrs caused by deformation of the parting portion. In Example 5, the resultant casting had good appearance as a whole, despite pinholes and seizures.

In Comparative Example 1, on the other hand, mold shakeout caused bad sand detachment, although the curing-material-fee recess had gas permeability of 160. In Comparative Example 2 applying a large amount of a curing material having viscosity of less than 1 mPa·S, the cured layer had gas permeability of less than 70, and the resultant casting had poor appearance due to pinholes and the deformation of parting portions. In Comparative Example 3 using water glass as a curing material, the cured layer 8 had gas permeability of 62, resulting in deteriorated sand detachment degree and poor casting appearance.

EXAMPLE 6

Casting Using Green Sand Mold Obtained by Second Method

Figure 3:
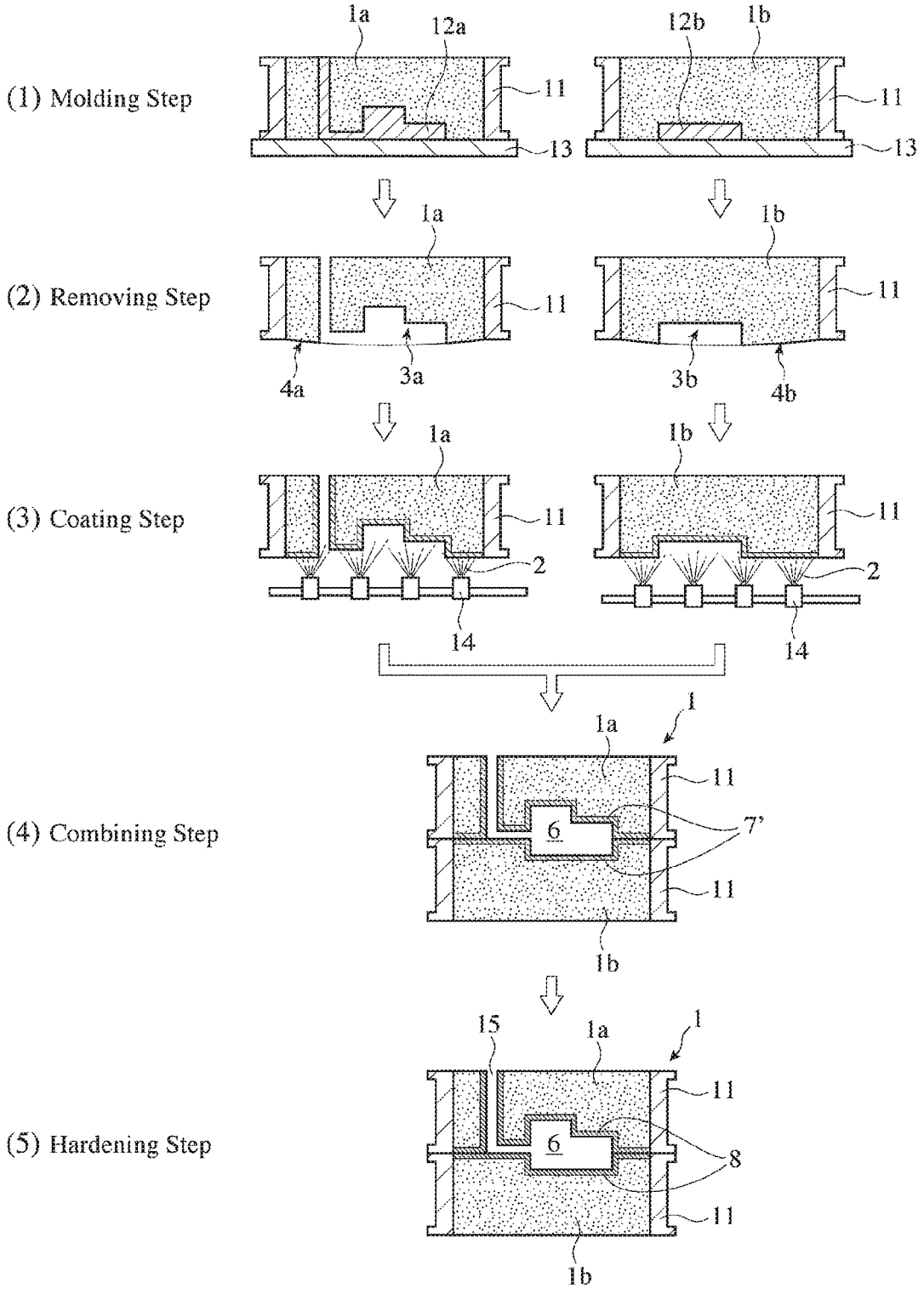
FIG. 3 is a schematic view showing steps of the second method of the present invention for producing a green sand mold.

The green sand mold 1 was produced in the same manner as in Example 1, except that a phenol resin having viscosity of 25 mPa·S was used as the curing material 2, and that the curing material 2 was substantially completely cured after mold parts are combined by the second method of the present invention, as shown in FIG. 3. The degree of sand detachment by mold shakeout and the appearance of the casting were evaluated. A time period between the completion of coating and combining the molds was 2 minutes. The results are shown in Table 2. Table 2 shows that the mating surface coated with the curing material had hardness of 8, and the cured layer 8 had hardness of 80 and a thickness of 2 mm.

COMPARATIVE EXAMPLE 4

The green sand mold 1 was produced in the same manner as in Example 6 except that the curing material 2 had viscosity of 150 mPa·S. The degree of sand detachment by mold shakeout and the appearance of the casting were evaluated. The results are shown in Table 2. As is clear from Table 2, the cured layer 8 had a thickness of 0.2 mm, because the curing material 2 had too large viscosity to penetrate into the green sand mold 1. Because such a cured layer 8 had no anchoring effect to a surface of the green sand mold 1, the cured layer 8 partially peeled off, and a melt penetrated into exposed portions of the sand mold, causing seizure.

EXAMPLES 7-9 AND COMPARATIVE EXAMPLES 5 AND 6

The green sand mold 1 was produced in the same manner as in Example 6 except for changing the type, viscosity and amount of the curing material, and the hardness of the mating surface coated before the mold parts were combined, as shown in Table 2. The degree of sand detachment by mold shakeout and the appearance of the casting were evaluated. The results are shown in Table 2.

TABLE 2

| | No. | | | |
|---|---|---|---|---|
| | Example 6 | Com. Ex. 4 | Example 7 | Example 8 |
| Hardness of Green Sand Mold | 20 | 20 | 35 | 18 |
| Curing Material | | | | |
| Type | Ph(1) | Ph(1) | Ph(1) | Ph(1) |
| Viscosity (mPa · S)(5) | 25 | 150 | 100 | 15 |
| Amount (g/M$^2$) | 400 | 100 | 550 | 100 |
| Hardness after Coated | 8 | 20 | 30 | 5 |
| Cured Layer | | | | |
| Hardness | 80 | 82 | 95 | 76 |
| Thickness (mm) | 2 | 0.2 | 0.5 | 2.2 |
| Gas permeability(6) | 110 | 60 | 85 | 145 |
| Evaluation | | | | |
| Sand Detachment Degree (%) | 62 | 98 | 70 | 78 |
| Appearance of Casting | Very Good | Fair | Very Good | Very Good |

| | No. | | |
|---|---|---|---|
| | Example 9 | Com. Ex. 5 | Com. Ex. 6 |
| Hardness of Green Sand Mold | 20 | 35 | 19 |
| Curing Material | | | |
| Type | Ep(2) | Fr(3) | Gl(4) |
| Viscosity (mPa · S)(5) | 100 | 100 | 2 |
| Amount (g/m$^2$) | 800 | 95 | 100 |
| Hardness after Coated | 4 | 31 | 13 |

TABLE 2-continued

| | | | |
|---|---|---|---|
| Cured Layer | | | |
| Hardness | 98 | 38 | 55 |
| Thickness (mm) | 2 | 0.4 | 4 |
| Gas permeability(6) | 79 | 72 | 64 |
| Evaluation | | | |
| Sand Detachment Degree (%) | 80 | 95 | 88 |
| Appearance of Casting | Good | Poor | Poor |

Note:
(1)Phenol resin.
(2)Epoxy resin.
(3)Furan resin.
(4)Water glass.
(5)Viscosity measured by a Brookfield viscometer according to JIS K6910.
(6)Measured by a rapid method described in Annex 3 of JIS Z 2601.

As is clear from Table 2, good sand detachment degree by mold shakeout and good appearance of the casting were obtained in Examples 6-9 where the curing material having viscosity of 15-100 mPa·S was applied to the mating surface of the green sand mold, and the curing step was conducted only after the combining step. Especially in Examples 6-8, the sand detachment degree and the appearance of the casting were very good, because a phenol resin was used as a thermosetting resin, because the curing material layer had hardness of 5-30, and because the cured layer had hardness of 40-98, a thickness of 0.5-2.2 mm, and gas permeability of 70-150.

In Comparative Example 4, on the other hand, the cured layer peeled off, causing seizure, because the curing material had viscosity of more than 100 mPa·S. Comparative Example 5 provided deteriorated sand detachment degree, resulting in poor appearance of the casting, because the cured layer had a thickness of less than 0.5 mm. In Comparative Example 6, the iron-based casting had poor appearance with gas defects such as pinholes because the gas permeability was less than 70.

EFFECTS OF THE INVENTION

The method of the present invention can produce an iron-based casting having excellent dimensional accuracy and appearance, while preventing defects even with a green sand mold coated with a curing material on its mating surfaces.

What is claimed is:

1. A method for producing a green sand mold comprising at least one pair of green sand mold parts each comprising a recess and a mating surface, a cured layer comprising a heat hardened thermosetting resin as a main component being formed on the whole of the recess and mating surface of each of the green sand mold parts; and said cured layer having hardness of 40-98 measured by a self-hardening hardness meter NK-009, available from Nakayama Co., Ltd., a thickness of 0.5-6 mm, and gas permeability measured by a rapid method described in Annex 3 of JIS Z 2601 of 70-150, comprising the steps of applying a curing material consisting of a thermosetting resin and alcohol and having viscosity of 1-100 mPa·S to a recess and a mating surface of each of the green sand mold parts;

combining the green sand mold parts; and then heat-hardening the curing material at a temperature of 80-180° C.

2. The method for producing the green sand mold according to claim 1, wherein the amount of the curing material applied is 100-550 g/m$^2$ .

3. The method for producing the green sand mold according to claim 1, comprising the steps of applying a curing material having viscosity of 1-15 mPa·S to a recess and a mating surface of each of the green sand mold parts;

semi-hardening the curing material penetrated into the green sand mold parts;

combining the green sand mold parts; and then heating the semi-cured layer to form a substantially completely cured layer.

4. The method for producing the green sand mold according to claim 3, wherein the hardness of the semi-cured layer measured by a self-hardening hardness meter is 30-45.

5. The method for producing the green sand mold according to claim 3, wherein the thickness of the cured layer is 2.2-6 mm.

6. The method for producing the green sand mold according to claim 3, wherein said semi-hardening of the curing material is conducted by heating using an incandescent lamp and said heating of the semi-cured layer is conducted by heating using hot air.

7. The method for producing the green sand mold according to claim 3, wherein said curing material has viscosity of 1-10 mPa·S.

8. The method for producing the green sand mold according to claim 1, comprising the steps of applying a curing material having viscosity of 15-100 mPa·S to a recess and a mating surface of each of the green sand mold parts;

combining the green sand mold parts; and then heat-hardening the curing material to form a substantially completely cured layer.

9. The method for producing a green sand mold according to claim 8, wherein a curing material layer before the green sand mold parts are combined has hardness measured by a self-hardening hardness meter of 5-30.

10. The method for producing the green sand mold according to claim 8, wherein the cured layer has a thickness of 0.5-2.2 mm.

* * * * *